US009449776B2

(12) United States Patent
Cho et al.

(10) Patent No.: US 9,449,776 B2
(45) Date of Patent: Sep. 20, 2016

(54) CIRCUIT BREAKER WITH INPUT LOAD INCREASING MEANS

(71) Applicant: LSIS CO., LTD., Anyang-si, Gyeonggi-do (KR)

(72) Inventors: Seong Yeol Cho, Cheongju-si (KR); Jae Kwan Seo, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/528,933

(22) Filed: Oct. 30, 2014

(65) Prior Publication Data

US 2015/0137916 A1 May 21, 2015

(30) Foreign Application Priority Data

Nov. 19, 2013 (KR) ..... 10-2013-0140834

(51) Int. Cl.

| | |
|---|---|
| ***H01H 83/00*** | (2006.01) |
| ***H01H 73/02*** | (2006.01) |
| ***H01H 75/00*** | (2006.01) |
| ***H01H 77/00*** | (2006.01) |
| ***H01H 71/24*** | (2006.01) |
| ***H01H 71/52*** | (2006.01) |
| ***H01H 71/02*** | (2006.01) |

(52) U.S. Cl.

CPC ..... *H01H 71/2472* (2013.01); *H01H 71/0207* (2013.01); *H01H 71/525* (2013.01)

(58) Field of Classification Search

CPC ..... H01H 71/525; H01H 71/2472; H01H 71/0207

USPC ..... 335/21

See application file for complete search history.

(56) References Cited

U.S. PATENT DOCUMENTS 3,614,685 A 10/1971 Ellsworth et al.
2009/0039988 A1* 2/2009 Song et al. ..... 335/21

(Continued)

FOREIGN PATENT DOCUMENTS

CN 101165834 A 4/2008
CN 103201817 A 7/2013
EP 2654064 10/2013

(Continued)

OTHER PUBLICATIONS

Japan Patent Office Application Serial No. 2014-234602, Office Action dated Sep. 15, 2015, 2 pages.

(Continued)

*Primary Examiner* — Bernard Rojas

(74) *Attorney, Agent, or Firm* — Lee, Hong, Degerman, Kang & Waimey; Jonathan Kang; Richard Salfelder

(57) ABSTRACT

A circuit breaker comprises a switching mechanism that including a linkage with a drive joint that is mounted to be rotatable around a rotation axis by a driving force, wherein, during the ON operation, an axis formed by the rotation axis and the point of action of the driving force makes an acute angle with the line of action of the driving force, so that the drive joint causes the tangential force of the driving force to act as input load, at least one hinge part of the linkage is configured in a way that the connecting pin is movably hinged to the long hole-shaped hinge hole, and at least one hinge part of the linkage causes the tangential force to increase by changes in the acute angle as the connecting pin moves from a first side of the long hole-shaped hinge hole to a second side.

6 Claims, 8 Drawing Sheets

(56) References Cited

U.S. PATENT DOCUMENTS

| | | | | |
|---|---|---|---|---|
| 2010/0134221 | A1* | 6/2010 | Mittelstadt et al. | 335/9 |
| 2015/0107981 | A1* | 4/2015 | Cho | 200/558 |

FOREIGN PATENT DOCUMENTS

| | | | |
|---|---|---|---|
| GB | 1288716 | | 9/1972 |
| JP | 10223115 | A | 8/1998 |
| JP | 2000-260291 | | 9/2000 |
| JP | 2014-234602 | | 12/2014 |

OTHER PUBLICATIONS

European Patent Office Application Serial No. 14191195.8, Search Report dated Mar. 24, 2015, 5 pages.

Japan Patent Office Application Serial No. 2014-234602, Office Action dated Jan. 5, 2016, 3 pages.

State Intellectual Property Office of the People's Republic of China Application Serial No. 201410665057.1, Office Action dated Apr. 7, 2016, 5 pages.

* cited by examiner

CIRCUIT BREAKER WITH INPUT LOAD INCREASING MEANS

CROSS-REFERENCE TO RELATED APPLICATION

Pursuant to 35 U.S.C. §119(a), this application claims the benefit of earlier filing date and right of priority to Korean Application No. 10-2013-0140834, filed on Nov. 19, 2013, the contents of which is incorporated by reference herein in its entirety.

BACKGROUND OF THE INVENTION

1. Field of the Invention

The present invention relates to a circuit breaker, and more particularly, to a circuit breaker which can open and close a line by a driving force obtained by a spring and a linkage.

2. Background of the Invention

In general, a circuit breaker is an electrical device that protects circuits and load devices by automatically closing a line in the event of an abnormal current.

FIG. 1 is a cross-sectional view showing a conventional circuit breaker in a manual OFF position.

As shown in FIG. 1, the conventional circuit breaker includes a fixed contact FC within a case C, a moving contact OC rotatably mounted on the case C at one end to be brought into contact with or separated from the fixed contact FC, and a switching mechanism that generates a driving force to rotate the moving contact OC.

The fixed contact FC includes a fixed point of contact FCP on one side.

The moving contact OC includes a moving point of contact OCP on one side.

The switching mechanism includes a linkage, a handle 10 spaced away from the linkage, a tension spring S connecting the linkage and the handle 10, a transfer link 90 that transfer a driving force from the linkage to the moving contact OC.

The linkage includes a trip latch 20 for performing a tripping operation, a first rocker 40 hinged to the trip latch 20, a second rocker 80 hinged to the case C, and a connecting link 60 connecting the first rocker 40 and the second rocker 80.

One end of the trip latch 20 is hinged to the case C, and the other end thereof is held by a latch holder 28.

The trip latch 20 includes a latch hinge hole 26 on one side.

One end of the first rocker 40 is hinged to the latch hinge hole 26 by a first rotation axis 30.

As such, the first rocker 40 is rotatably mounted on the first rotation axis 30.

The second rocker 80 is spaced away from the first rocker 40.

More specifically, one end of the second rocker 80 is hinged to the case C by a second rotation axis 82.

As such, the second rocker 80 is rotatably mounted on the second rotation axis.

Moreover, the second rocker 80 includes a primary second rocker hinge hole 84 and a secondary second rocker hinge hole (not shown).

One end of the connecting link 60 is hinged to the other end of the first rocker 40 by a first pin 50, and the other end thereof is hinged to the primary second rocker hinge hole 84 by a second pin 70.

The first pin 50 includes a first spring fastener 52 for supporting one end of the tension spring S.

One end of the handle 10 is hinged to the case C, and the other end thereof protrudes from the case C.

A second spring fastener 16 for supporting the other end of the tension spring S is provided on one side of the handle 10.

One end of the tension spring S is supported on the first spring 52, and the other end thereof is supported on the second spring fastener 16.

As such, the tension spring S generates a driving force on the first pin 50.

One end of the transfer link 90 is hinged to the secondary second rocker hinge hole (not shown) by a third pin 92, and the other end thereof is hinged to a moving contact hinge hole (not shown) by a fourth pin 94.

With this configuration, the conventional circuit breaker in the manual OFF position is put into the ON position as the handle 10 rotates counterclockwise as shown in the drawing.

The tension spring S rotates counterclockwise as shown in the drawing on the first spring fastener 52 by the rotation of the handle.

The first rocker 40 rotates clockwise as shown in the drawing around the first rotation axis 30 by means of the tension spring S.

Accordingly, the connecting link 60 rotates and moves counterclockwise as shown in the drawing by means of the first rocker 40 and the first pin 50.

The second rocker 80 rotates clockwise as shown in the drawing around the second rotation axis 82 by means of the connecting link 60.

Accordingly, the third pin 92 moves clockwise as shown in the drawing along the circumference around the second rotation axis 82.

The transfer link 90 rotates and moves counterclockwise as shown in the drawing by means of the second rocker 80 and the third pin 92.

The moving contact OC rotates counterclockwise as shown in the drawing around a moving contact rotation axis OCA by means of the transfer link 90.

As such, the moving point of contact OCP is brought into contact with the fixed point of contact FCP.

That is, the circuit breaker is put into the ON position.

By the way, if the conventional circuit breaker requires an increased number of moving contacts OC and increased input load for a change in perturbation structure, it is necessary to increase the load on the tension spring S or change the link structure and link ratio of the switching mechanism.

However, increasing the load on the tension spring S leads to the problem of increased load for all operations except the ON operation.

Meanwhile, changing the link structure and link ratio of the switching mechanism may give unnecessary effects (e.g., increasing the user operability for a reset operation) on operations other than the ON operation. Also, since a breaker and a switching mechanism cannot be used together if they are of different types, the switching mechanism as well needs to be modified in order to dualize the switching mechanism or use it together with the breaker.

SUMMARY OF THE INVENTION

Therefore, an aspect of the present invention is to provide a circuit breaker which can increase input load, without developing a new switching mechanism by increasing the load on a tension spring or changing the link structure and link ratio of a switching mechanism.

To achieve these and other advantages and in accordance with the purpose of this specification, as embodied and broadly described herein, there is provided a circuit breaker including: a case; a fixed contact mounted within the case; a moving contact rotatably mounted on the case to be brought into contact with or separated from the fixed contact; and a switching mechanism that generates a driving force to rotate the moving contact, the switching mechanism including a linkage with a drive joint that is mounted to be rotatable around a rotation axis by the driving force, wherein, during the ON operation, an axis formed by the rotation axis and the point of action of the driving force makes an acute angle with the line of action of the driving force, so that the drive joint causes the tangential force at the circumference of the point of action of the driving force to act as input load, at least one hinge part of the linkage is configured in a way that a connecting pin is movably hinged to the long hole-shaped hinge hole, and during the ON operation, at least one hinge part of the linkage causes the tangential force to increase by changes in the acute angle as the connecting pin moves from a first side of the long hole-shaped hinge hole to a second side.

According to one embodiment of the present invention, the linkage may include: a trip latch, one end of which is hinged to the inside of the case and the other end of which is held by a latch holder; a first rocker, one end of which is hinged to the trip latch by a first rotation axis; a second rocker spaced away from the first rocker, one end of which is hinged to the case by a second rotation axis; and a connecting link, one end of which is hinged to the other end of the first rocker by a first pin and the other end of which is hinged to the other end of the second rocker by a second pin.

The second rocker may include a long hole-shaped second rocker hinge hole at the other end, and the connecting link may be hinged to the long hole-shaped second rocker hinge hole.

The first rocker may be the drive joint, the first rotation axis may be the rotation axis, the second pin may be the connecting pin, and the long hole-shaped second rocker hinge hole may be the long hole-shaped hinge hole.

The long hole-shaped second rocker hinge hole may represent the terminal symbol of a flowchart.

A first arc of the symbol may be the first side, and a second arc of the symbol may be the second side.

The switching mechanism may include: a handle spaced away from the linkage, one end of which is hinged to the case and the other end of which protrudes from the case; and a tension spring, one end of which is supported on the handle and the other end of which is supported on the first pin, and which exerts a driving force on the first pin.

The first pin may include a first spring fastener for supporting one end of the tension spring.

The handle may include a second spring fastener on one side to support the other end of the tension spring.

The first spring fastener may be the point of action, and an axis formed by the first spring fastener and the second spring fastener may be the line of action.

The first side may be formed in a position where a first angle formed by the first rotation axis, the first spring fastener, and the second spring fastener makes an acute angle when the connecting pin is located on the first side during the ON operation.

The second side may be formed in a position where a second angle formed by the first rotation axis, the first spring fastener, and the second spring fastener makes an angle being larger than the first angle and smaller than 90 degrees when the connecting pin is located on the second side during the ON operation.

The switching mechanism may further include a transfer link that transfer a driving force from the linkage to the moving contact.

One end of the transfer link may be hinged to one side of the second rocker, and the other end thereof may be hinged to one side of the moving contact.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, an exemplary embodiment of the present invention will be described with reference to the accompanying drawings.

Figure 1:
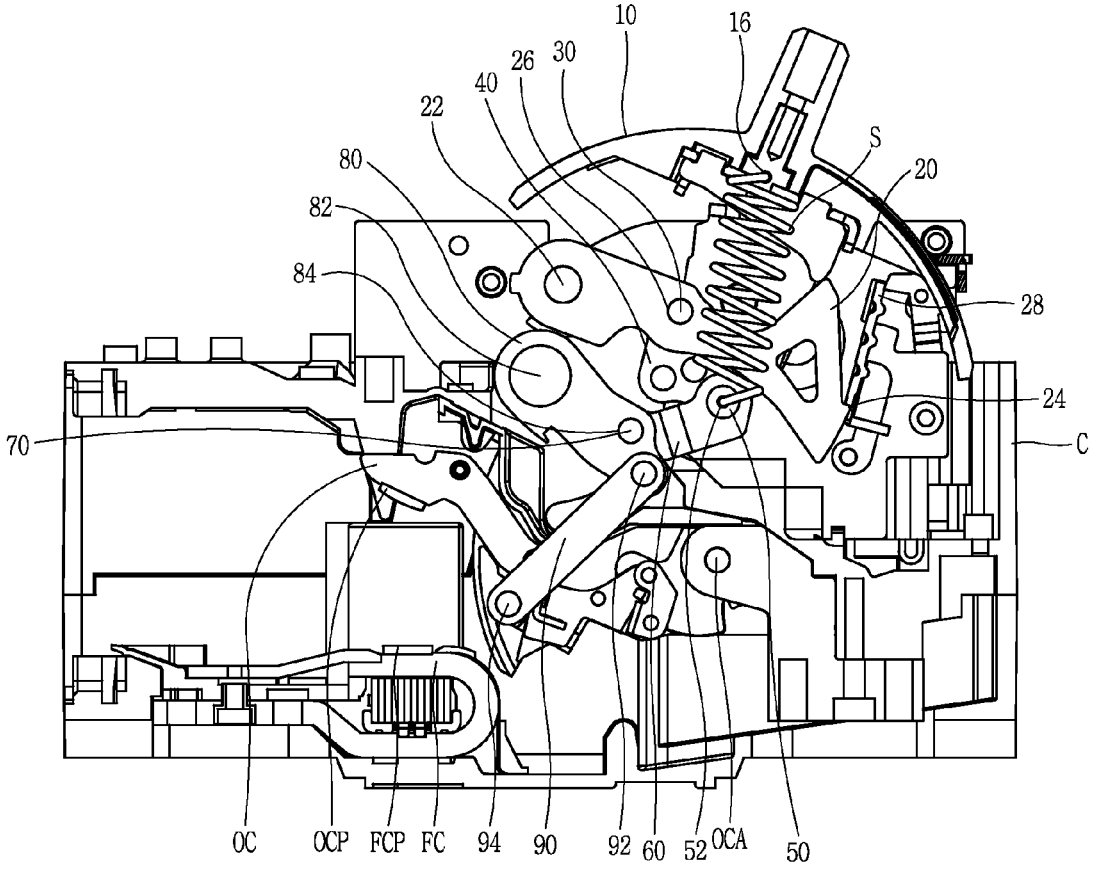
FIG. 1 CONVENTIONAL ART
FIG. 1 is a cross-sectional view showing a conventional circuit breaker.
Figure 2:
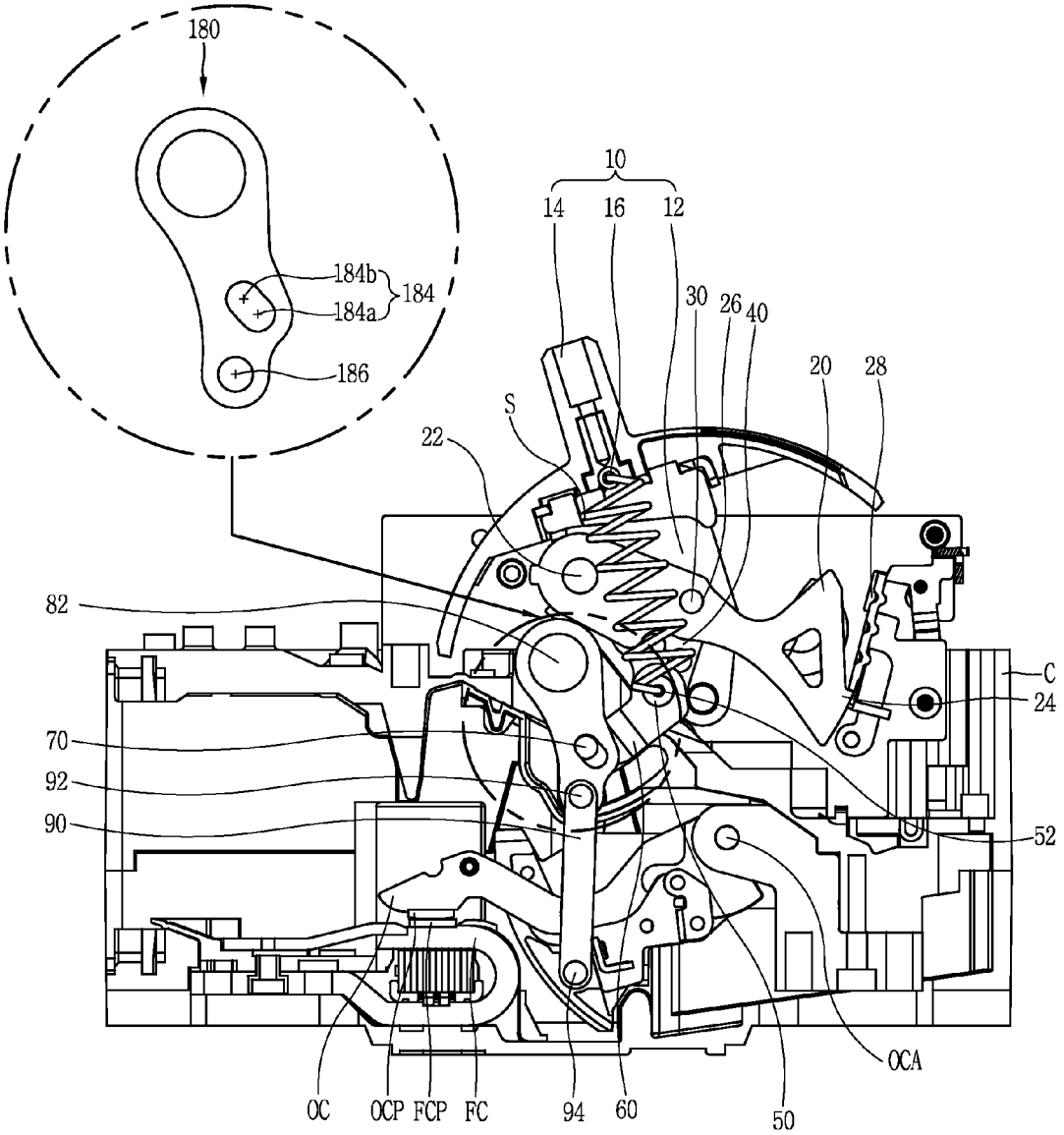
FIG. 2 is a cross-sectional view showing an internal structure of a circuit breaker according to the present invention when it is in an ON position.
Figure 3:
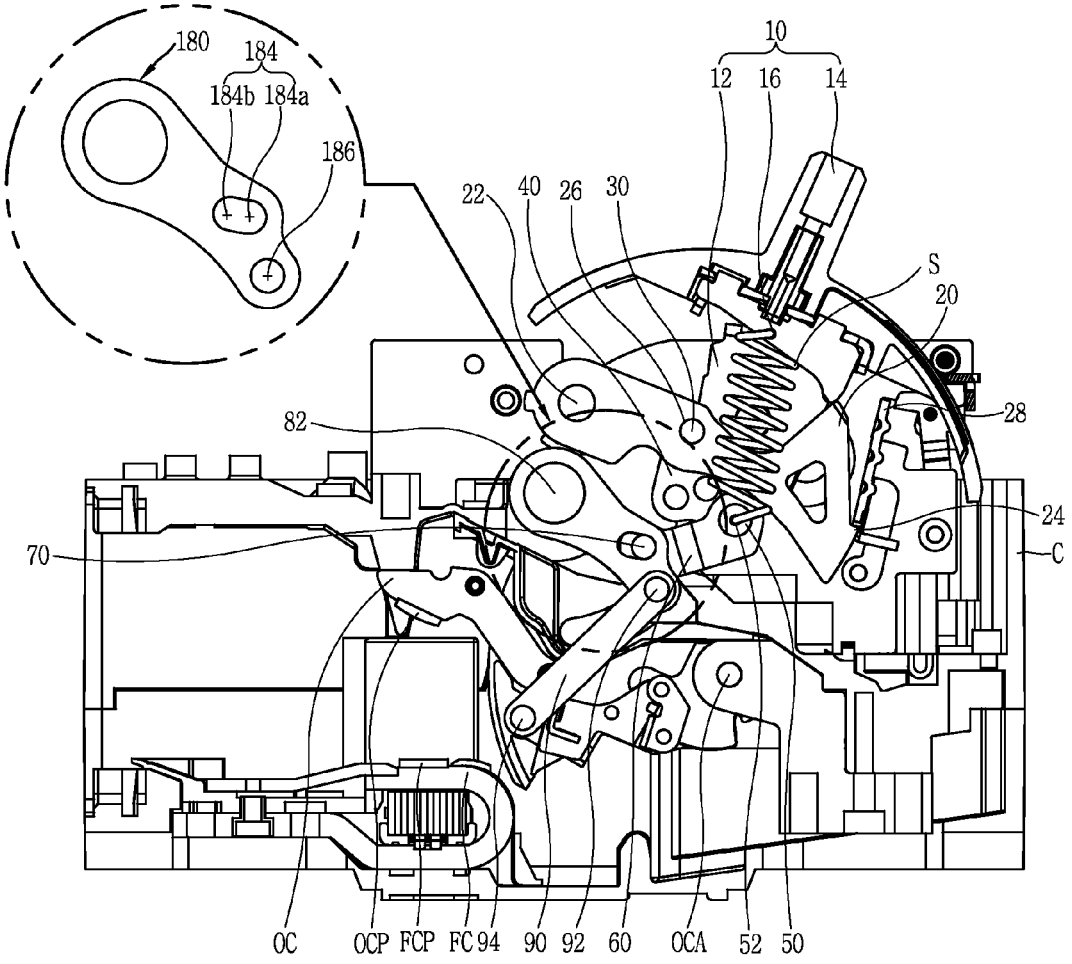
FIG. 3 is a cross-sectional view showing an internal structure of the circuit breaker of FIG. 2 when it is in a manual OFF position.
Figure 4:
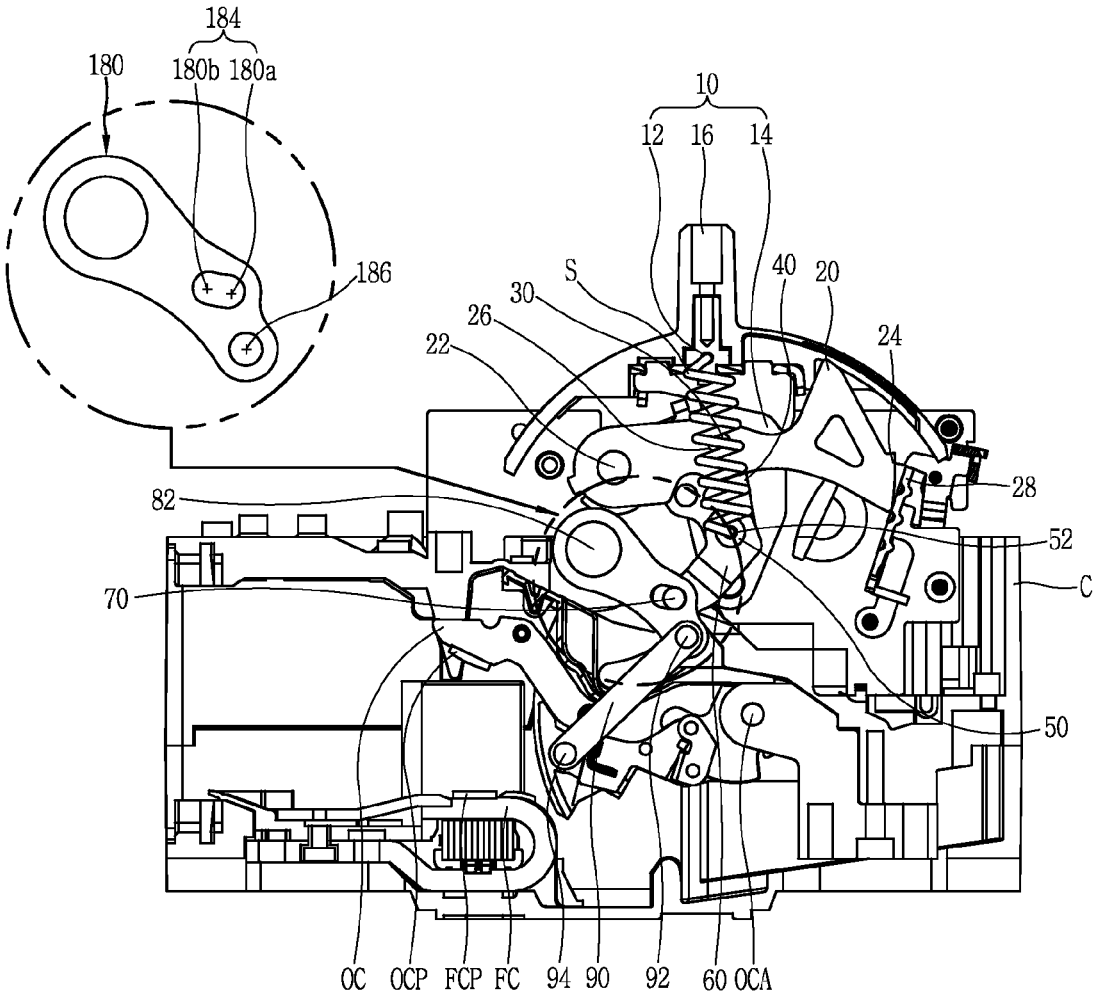
FIG. 4 is a cross-sectional view showing an internal structure of the circuit breaker of FIG. 2 when it is in a tripped position due to an accident.

FIG. 2 is a cross-sectional view showing an internal structure of a circuit breaker according to the present invention when it is in an ON position. FIG. 3 is a cross-sectional view showing an internal structure of the circuit breaker of FIG. 2 when it is in a manual OFF position. FIG. 4 is a cross-sectional view showing an internal structure of the circuit breaker of FIG. 2 when it is in a tripped position due to an accident.

Figure 5:
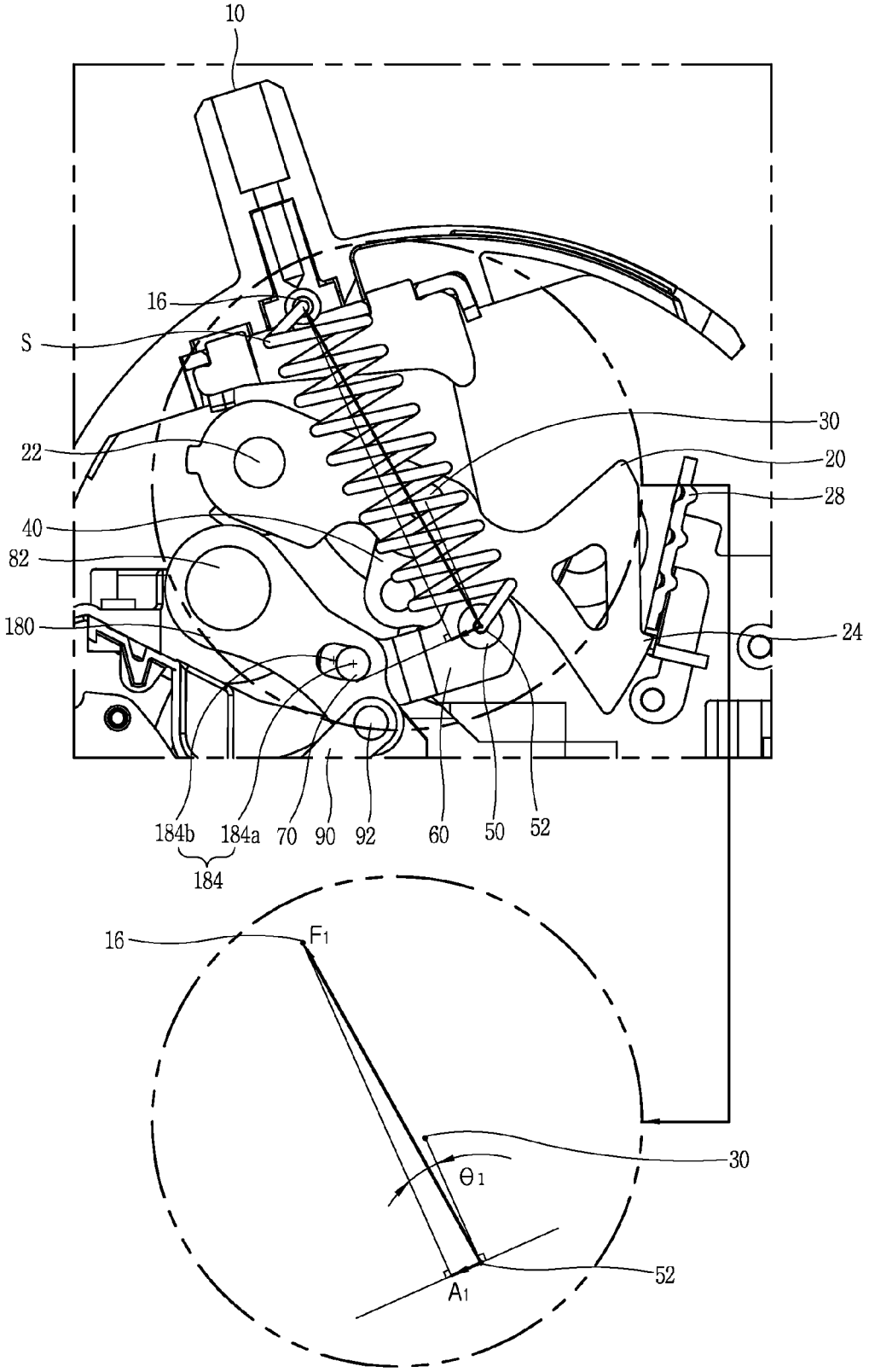
FIG. 5 is a cross-sectional view showing the input load applied when a second pin is located on a first side during the transition from the manual OFF position to the ON position.
Figure 6:
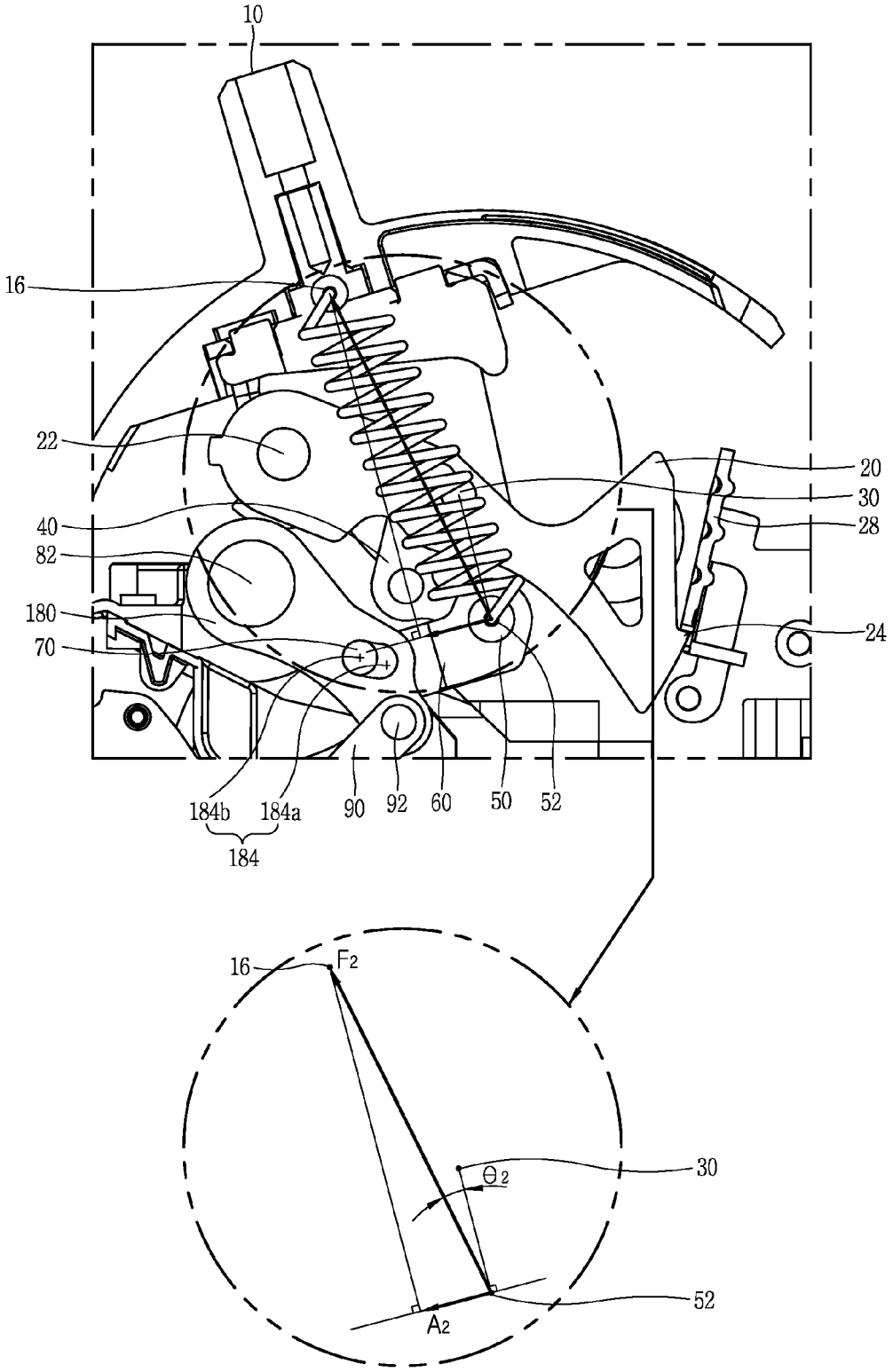
FIG. 6 is a cross-sectional view showing the input load increasing as the second pin of FIG. 5 moves to a second side.

FIG. 5 is a cross-sectional view showing the input load applied when a second pin is located on a first side during the transition from the manual OFF position to the ON position. FIG. 6 is a cross-sectional view showing the input load increasing as the second pin of FIG. 5 moves to a second side.

Figure 7:
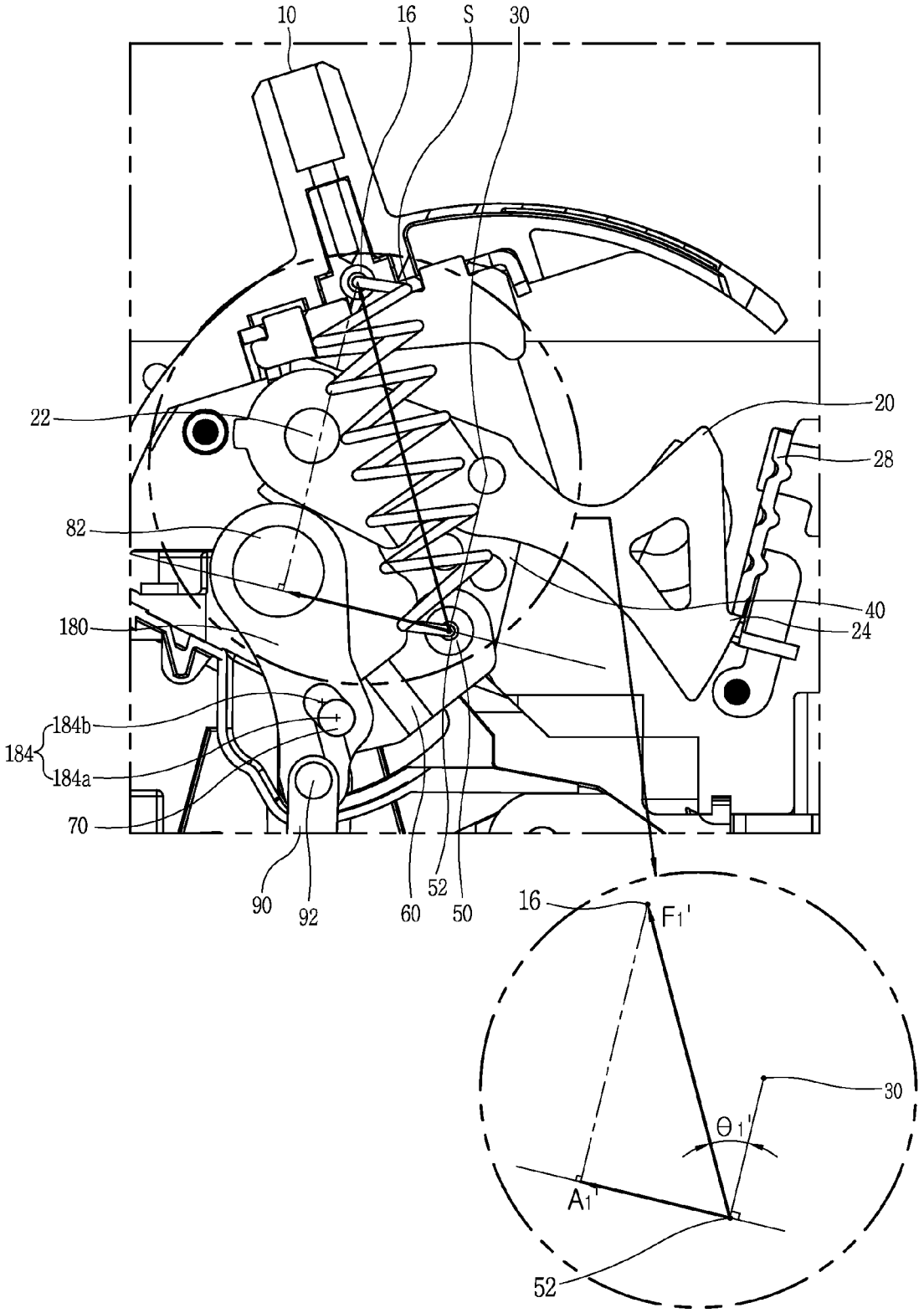
FIG. 7 is a cross-sectional view showing the input load applied when the second pin is located on the first side during the ON operation of FIG. 2.
Figure 8:
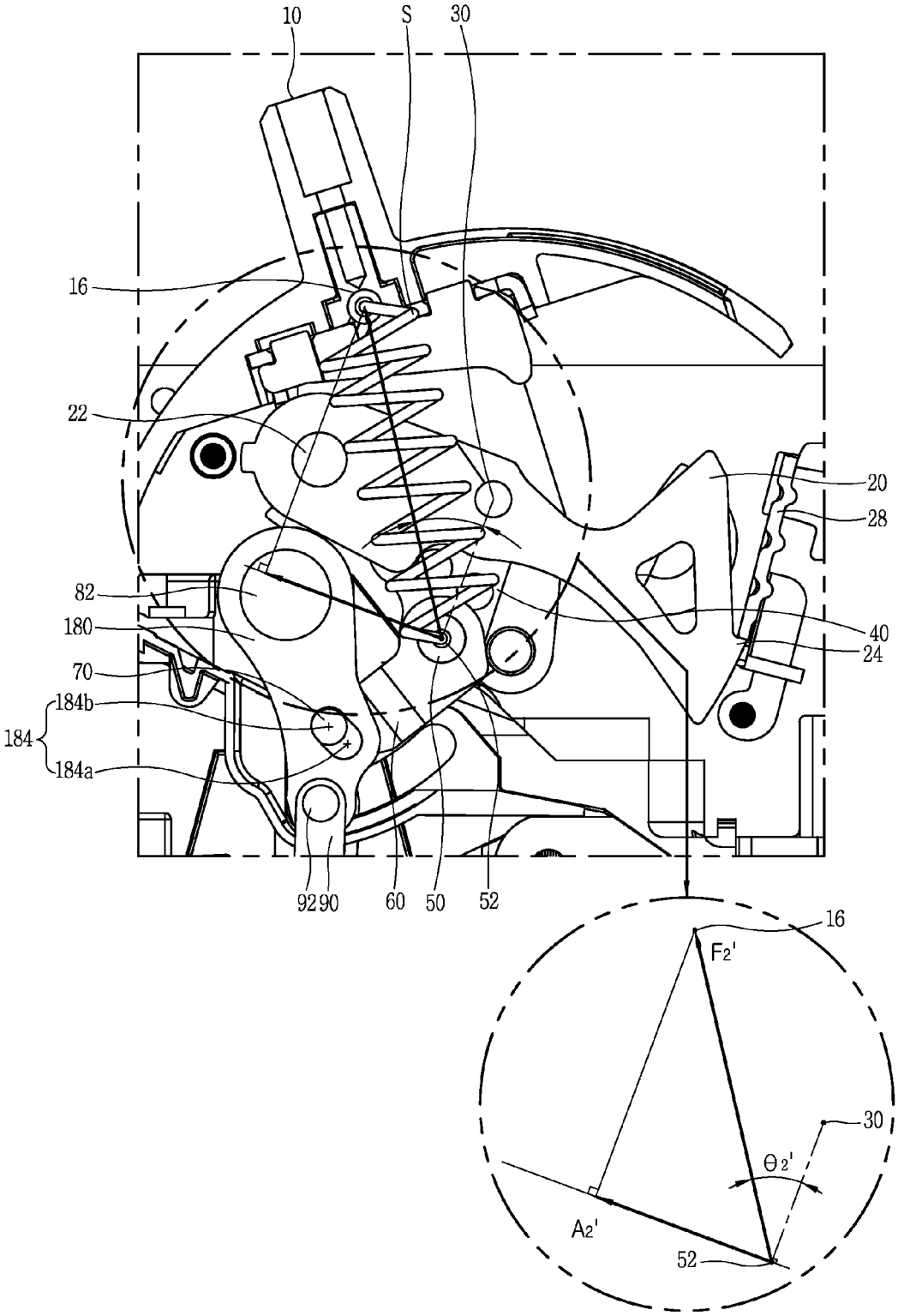
FIG. 8 is a cross-sectional view showing the input load increasing as the second pin of FIG. 7 moves to the second side.

FIG. 7 is a cross-sectional view showing the input load applied when the second pin is located on the first side during the ON operation of FIG. 2. FIG. 8 is a cross-sectional view showing the input load increasing as the second pin of FIG. 7 moves to the second side.

As shown in FIGS. 2 to 8, the circuit breaker according to the present invention includes a fixed contact FC within a case C, a moving contact OC rotatably mounted on the case C at one end to be brought into contact with or separated from the fixed contact FC, and a switching mechanism that generates a driving force to rotate the moving contact OC.

The fixed contact FC may be fixed to one side inside the case C.

The fixed contact FC may include a fixed point of contact FCP on one side that is conductively connected to a power supply side (not shown).

One end of the moving contact OC may be hinged to the case C by means of a moving contact rotation axis OCA.

The moving contact OC may include a moving point of contact OCP at one end that is conductively connected to a load side (not shown). The other end of the moving contact OC refers to the opposite side of the moving contact rotation axis OCA.

The moving contact OC may include a moving contact hinge hole (not shown) between one end and the other end so as to be hinged to a transfer link 90 to be described later.

As such, the moving contact OC may rotate in a first or second direction around the moving contact rotation axis OCA by a driving force transferred from the transfer link 90.

Accordingly, the moving point of contact OCP may be brought into contact with or separated from the fixed point of contact FCP.

The switching mechanism includes a linkage, a handle 10 spaced away from the linkage, a tension spring S connecting the linkage and the handle 10, a transfer link 90 that transfer a driving force from the linkage to the moving contact OC.

The linkage includes a trip latch 20 for performing a tripping operation, a first rocker 40 hinged to the trip latch 20, a second rocker 180 hinged to the case C, and a connecting link 60 connecting the first rocker 40 and the second rocker 180.

The trip latch 20 may be in the shape of a bar.

One end of the trip latch 20 may be hinged to the case C by a latch rotation axis 22, and the other end thereof may be held by a latch holder 28. The other end of the trip latch 20 refers to the opposite side of the latch rotation axis 22.

A protrusion 24 to be caught by the latch holder 28 may be formed at the tip of the other end of the trip latch 20.

The trip latch 20 may include a latch hinge hole 26 between one end and the other end.

With this configuration, when the circuit breaker is put into the ON position or manual OFF position, the protrusion of the trip latch 20 may be caught and held by the groove of the latch holder 28. As such, the trip latch 20 may serve as a fixed support point to activate other components of the switching mechanism.

When the circuit breaker is put into the tripped position due to an accident, the trip latch 20 may be released from the latch holder 28 and become rotatable. As such, the trip latch 20 may serve as a single link member which is connected to other components of the switching mechanism.

One end of the first rocker 40 may be hinged to the latch hinge hole 26 by a first rotation axis 30.

The first rocker 40 may include a first rocker hinge hole (not shown) at the other end that is hinged to the connecting link 60 by means of a first pin 50.

The first rocker 40 is rotatably mounted on the first rotation axis 30 by a spring force received from a first spring fastener 52 of the first pin 50 to be described later, and serves as a drive joint of the linkage.

The second rocker 180 is spaced away from the first rocker 40, and serves to transfer the force received from the first rocker 40 through the connecting link 60 to the moving contact OC through the transfer link 90.

More specifically, one end of the second rocker 180 may be hinged to the case C by means of a second rotation axis 82.

As such, the second rocker 180 may be rotatably mounted on the second rotation axis 82.

The second rocker 180 may include a long hole-shaped, primary second rocker hinge hole 184 at the other end that is hinged to the connecting link 60 by means of a second pin 70.

The long hole-shaped, primary second rocker hinge hole 184 will be described in further details later.

Furthermore, the second rocker 180 may include a circular-shaped, secondary second rocker hinge hole 186 at the other end that is hinged to the transfer link 90 by means of a third pin 92.

The circular-shaped, secondary second rocker hinge hole 186 may be provided on the opposite side of the second rotation axis 82 with respect to the long hole-shaped, primary second rocker hinge hole 184.

The connecting link 60 may be a link member having a hinge hole at either end.

As such, one end of the connecting link 60 may be hinged to the first rocker hinge hole (not shown) by means of the first pin 50, and the other end thereof may be hinged to the long hole-shaped, primary second rocker hinge hole 184 by means of the second pin 70.

The first pin 50 may include a first spring fastener 52 for supporting one end of the tension spring S.

One end of the handle 10 may be hinged to the case C, and the other end thereof may protrude from the case C.

More specifically, the handle 10 may include a lever 12 whose one end is rotatably hinged to the case C and a gripping part 14 that longitudinally extends from the other end of the lever 12 and protrudes out of the case C.

The handle 10 may include a second spring fastener 16 provided at a connecting region of the lever 12 and the gripping part 14 and for supporting the other end of the tension spring S.

In this case, the handle 10 may be adapted to be rotatable in the first or second direction within a given angle.

When the circuit breaker is switched from the ON position to the OFF or tripped position, the second spring fastener 16 may move from one side to the opposite side on the axis where the first rotation axis 30 and the first spring fastener 52 are located, One end of the tension spring S may be supported on the first spring fastener 52, and the other end thereof may be supported on the second spring fastener 16.

As such, the tension spring S may exert a driving force on the first pin 50.

The transfer link 90 may be a link member having a hinge hole at either end.

As such, one end of the transfer link 90 may be hinged to the secondary circular-shaped, second rocker hinge hole 186 by the third pin 92, and the other end thereof may be hinged to the moving contact hinge hole (not shown) by a fourth pin 94.

The components of the switching mechanism and the overall relationship of connections between the components have been described so far.

The long hole-shaped, primary second rocker hinge hole 184, which is a main part of the present invention, will be described in further details.

The long hole-shaped, primary second rocker hinge hole 184 may be adapted to be movable to the first side 184*a* or second side 184*b* within the primary second rocker hinge hole 184.

More specifically, the long hole-shaped, primary second rocker hinge hole 184 may represent the terminal symbol of a flowchart.

In this case, the region corresponding to a first arc of the symbol may be referred to as the first side 184*a*, and the region corresponding to a second arc of the symbol may be referred to as the second side 184*b*.

In other words, when there are two concentric circles of the same size and two tangent lines that do not intersect each other are drawn from one of the concentric circles to the other, the long hole-shaped, primary second rocker hinge hole 184 may be in the shape of a symbol bounded by the two concentric lines and the two tangent lines.

In this case, the region corresponding to one of the concentric circles may be referred to as the first side 184*a*, and the region corresponding to the other may be referred to as the second side 184*b*.

The first side 184*a* and the second side 184*b* may be placed in the following positions based on a particular state. The particular state refers to an operating state which lasts from the point in time (hereinafter, "ON operation start point") when the circuit breaker is switched from the manual OFF position to the ON position as the handle 10 rotates counterclockwise as shown in the drawing until the point in time when the moving contact OC is separated from the fixed contact FC (hereinafter, "ON operation end point").

The first side 184*a* may be formed in a position where a first angle formed by the first rotation axis 30, the first spring fastener 52, and the second spring fastener 16 makes an acute angle when the second pin 70 is located on the first side 184*a* and the first pin 50, which is positioned by the connecting link 60 held by the second pin 70 and the first rocker 40 held by the first rotation axis 30, is located at a particular position on the circumference around the first rotation axis 30.

The second side 184*b* may be formed in a position where a second angle formed by the first rotation axis 30, the first spring fastener 52, and the second spring fastener 16 makes an angle being larger than the first angle and smaller than 90 degrees when the second pin 70 is located on the second side 184*b* and the first pin 50, which is positioned by the connecting link 60 held by the second pin 70 and the first rocker 40 held by the first rotation axis 30, is located at a different position from the particular position on the circumference around the first rotation axis 30.

Herein, the different position may be a position to which the first pin 50 is rotated clockwise as shown in the drawing from the particular position on the circumference around the first rotation axis 30.

When the region connecting the first side 184*a* and the second side 184*b* is referred to as a path side, the path side may have a straight-line trajectory. Alternatively, the path side may have a trajectory with a gentle curvature.

In this case, when the circuit breaker is in the tripped position due to an accident, the trip latch 20, the first rocker 40, the connecting link 60, and the second rocker 180 may constitute a 5-bar linkage (hereinafter, referred to as "5-bar linkage"), in which a virtual link between the latch rotation axis 22 and the second rotation axis 82 is fixed and the trip latch 20, the first rocker 40, the connecting link 60, and the second rocker 180 move.

In other words, when the circuit breaker is in the tripped position due to an accident, the trip latch 20, the first rocker 40, the connecting link 60, and the second rocker 180 may constitute a 5-bar linkage (hereinafter, referred to as "5-bar linkage"), in which the latch rotation axis 22 and the second rotation axis 82 are fixed and the first rotation axis 30, the first pin 50, and the second pin 70 move.

On the other hand, when the circuit breaker is in the ON position or the manual OFF position, the trip latch 20 may be fixed by the latch holder 28.

As such, the trip latch 20, the first rocker 40, the connecting link 60, and the second rocker 180 may constitute a 4-bar linkage (hereinafter, referred to as "first 4-bar linkage"), in which a virtual link between the first rotation axis 30 and the second rotation axis 82 is fixed and the first rocker 40, the connecting link 60, and the second rocker 180 move.

In other words, when the circuit breaker is in the ON position or the manual OFF position, the trip latch 20, the first rocker 40, the connecting link 60, and the second rocker 180 may constitute a 4-bar linkage (hereinafter, referred to as "first 4-bar linkage"), in which the first rotation axis 30 and the second rotation axis 82 are fixed and the first pin 50 and the second pin 70 move.

Moreover, the second rocker 180, the transfer link 90, and the moving contact OC may constitute a 4-bar linkage (hereinafter, referred to as "second 4-bar linkage"), in which a virtual link between the second rotation axis 82 and the moving contact rotation axis OCA is fixed and the second rocker 180, the transfer link 90, and the moving contact OC move.

In other words, the second rocker 180, the transfer link 90, and the moving contact OC may constitute a 4-bar linkage (hereinafter, referred to as "second 4-bar linkage"), in which the second rotation axis 82 and the moving contact rotation axis OCA are fixed and the third pin 92 and the fourth pin 94 move.

As used herein, the second 4-bar linkage may be a linkage that shares the second rocker 180 with the 5-bar linkage (or the first 4-bar linkage) and is driven by the 5-bar linkage (or the first 4-bar linkage).

In these drawings, the same components as those in the prior art are given the same reference numerals.

Now, operational effects of the circuit breaker according to the present invention will be described.

First, the procedure of switching the circuit breaker from the manual OFF position to the ON position will be described.

In the manual OFF position shown in FIG. 3, the handle 10 may rotate counterclockwise as shown in the drawing.

The tension spring S may rotate counterclockwise as shown in the drawing on the first spring fastener 52 by the rotation of the handle.

Accordingly, as shown in FIG. 5, a spring force may be applied to the first spring fastener 52 upward to the left in the drawing.

The spring force may act as torque that causes the first rocker 40 to rotate clockwise as shown in the drawing around the first rotation axis 30.

The torque can cause the second pin 70 to move from the first side 184*a* of the long hole-shaped, primary second rocker hinge hole 184 to the second side 184*b*.

Also, the torque can cause the second rocker 180 to rotate clockwise as shown in the drawing around the second rotation axis 82.

As such, referring to FIG. 3, in the first 4-bar linkage, the first rocker 40 may rotate clockwise as shown in the drawing around the first rotation axis 30.

The connecting link 60 may rotate and move counterclockwise as shown in the drawing by means of the first rocker 40 and the first pin 50.

The second pin 70 may move from the first side 184*a* of the long hole-shaped, primary second rocker hinge hole 184 to the second side 184*b* by means of the connecting link 60.

The second rocker 180 may rotate clockwise as shown in the drawing around the second rotation axis 82 by means of the connecting link 60 and the second pin 70.

Accordingly, in the second 4-bar linkage, the third pin 92 may move clockwise as shown in the drawing along the circumference around the second rotation axis 82 by the rotation of the second rocker 180.

The transfer link 90 may rotate and move counterclockwise as shown in the drawing by means of the second rocker 180 and the third pin 92.

The moving contact OC may rotate counterclockwise as shown in the drawing around the moving contact rotation axis OCA by means of the transfer link 90.

The moving point of contact OCP may be brought into contact with the fixed point of contact FCP by the rotation of the moving contact OC.

As a result, the circuit breaker is put into the ON position shown in FIG. 2.

In this procedure, the long hole-shaped, primary second rocker hinge hole 184 can increase input load without increasing the load on the tension spring S.

Now, increase in input load through the long-shaped, primary second rocker hinge hole 184 will be described with reference to FIGS. 5 to 8.

First of all, referring to FIGS. 5 and 6, an increase in input load occurring when the circuit breaker starts the ON operation will be described below.

It is assumed that the primary second rocker hinge hole 184 is formed concentrically, like the primary second rocker hinge hole 84, at a position corresponding to the first side 184*a* and the second pin 70 is hinged to the first side 184*a*, as in the conventional art.

In this case, as shown in FIG. 5, the first pin 50, which is positioned by the connecting link 60 held by the second pin 70, located on the first side 184*a*, and the first rocker 40 held by the first rotation axis 30, may be located at a particular position on the circumference around the first rotation axis 30.

The angle formed by the first rotation axis 30, the first spring fastener 52, and the second spring fastener 16 may make a first angle (hereinafter, "$\theta_1$").

Also, the spring force (hereinafter, "$F_1$") applied to the first spring fastener 52 upward to the left in the drawing can be resolved into a tangential force (hereinafter, "$A_1$") acting at the circumference around the first rotation axis 30 of the first spring fastener 52.

In this case, $A_1=F_1 \sin \theta_1$.

On the other hand, the primary second rocker hinge hole 184 may be formed in the shape of a long hole and the second pin 70 may move from the first side 184*a* to the second side 184*a*, as in the present invention.

In this case, as shown in FIG. 6, the first pin 50, which is positioned by the connecting link 60 held by the second pin 70, located on the second side 184*b*, and the first rocker 40 held by the first rotation axis 30, may be located at a different position to which the first pin 50 is rotated clockwise as shown in the drawing from the particular position on the circumference around the first rotation axis 30.

The angle formed by the first rotation axis 30, the first spring fastener 52, and the second spring fastener 16 may make a second angle (hereinafter, "$\theta_2$").

Also, the spring force (hereinafter, "$F_2$") applied to the first spring fastener 52 upward to the left in the drawing can be resolved into a tangential force (hereinafter, "$A_2$") acting at the circumference around the first rotation axis 30 of the first spring fastener 52.

In this case, $A_2=F_2 \sin \theta_2$.

When comparing the two cases, $F_1$ and $F_2$ may be different due to the difference in displacement between the springs.

However, it is concluded that $F_1 \approx F_2$ because the difference in displacement can be ignored considering the size of the circuit breaker.

As such, if 0 degree$<\theta_1<\theta_2<$90 degrees under the same amount of force, $A_1(=F_1 \sin \theta_1=F_2 \sin \theta_1)<A_2(=F_2 \sin \theta_2=F_1 \sin \theta_2)$ according to the relation: $\sin \theta_1<\sin \theta_2$.

Therefore, an increase in input load can be observed.

Next, referring to FIGS. 7 and 8, an increase in input load occurring when the circuit breaker finishes the ON operation will be described below.

It is assumed that the primary second rocker hinge hole 184 is formed concentrically, like the primary second rocker hinge hole 84, at a position corresponding to the first side 184*a* and the second pin 70 is hinged to the first side 184*a*, as in the conventional art.

In this case, as shown in FIG. 7, the first pin 50, which is positioned by the connecting link 60 held by the second pin 70, located on the first side 184*a*, and the first rocker 40 held by the first rotation axis 30, may be located at a particular position on the circumference around the first rotation axis 30.

The angle formed by the first rotation axis 30, the first spring fastener 52, and the second spring fastener 16 may make a first angle (hereinafter, "$\theta_1$").

Also, the spring force (hereinafter, "$F_1$") applied to the first spring fastener 52 upward to the left in the drawing can be resolved into a tangential force (hereinafter, "$A_1$") acting at the circumference around the first rotation axis 30 of the first spring fastener 52.

In this case, $A_1'=F_1' \sin \theta_1'$.

On the other hand, the primary second rocker hinge hole 184 may be formed in the shape of a long hole and the second pin 70 may move from the first side 184*a* to the second side 184*a*, as in the present invention.

In this case, as shown in FIG. 8, the first pin 50, which is positioned by the connecting link 60 held by the second pin 70, located on the second side 184*b*, and the first rocker 40 held by the first rotation axis 30, may be located at a different position to which the first pin 50 is rotated clockwise as shown in the drawing from the particular position on the circumference around the first rotation axis 30.

The angle formed by the first rotation axis 30, the first spring fastener 52, and the second spring fastener 16 may make a second angle (hereinafter, "$\theta_2$'").

Also, the spring force (hereinafter, "$F_2$'") applied to the first spring fastener 52 upward to the left in the drawing can be resolved into a tangential force (hereinafter, "$A_2$'") acting at the circumference around the first rotation axis 30 of the first spring fastener 52.

In this case, $A_2'=F_2' \sin \theta_2'$.

When comparing the two cases, $F_1'$ and $F_2'$ may be different due to the difference in displacement between the springs.

However, it is concluded that $F_1' \approx F_2'$ because the difference in displacement can be ignored considering the size of the circuit breaker.

As such, if 0 degree<$\theta_1'$<$\theta_2'$<90 degrees under the same amount of force, $A_1'$ (=$F_1'$ sin $\theta_1'$=$F_2'$ sin $\theta_1'$)<$A_2'$(=$F_2'$ sin $\theta_2'$=$F_1'$ sin $\theta_2'$) according to the relation: sin $\theta_1'$<sin $\theta_2'$.

Therefore, an increase in input load and an increase in contact maintenance between the moving contact OC and the fixed contact FC can be observed.

The procedure of switching the circuit breaker from the tripped position due to an accident to the ON position is identical to the procedure of switching the circuit breaker from the manual OFF position to the ON position, except that this procedure precedes the procedure of switching the circuit breaker from the tripped position of FIG. 4 due to an accident to the manual OFF position.

In this case, the circuit breaker can be switched from the tripped position due to an accident to the manual OFF position as the handle 10 rotates clockwise as shown in the drawing and the protrusion 24 is caught by the groove of the latch holder 28.

Accordingly, a detailed description of the procedure of switching the circuit breaker from the tripped position due to an accident to the ON position will be omitted to avoid redundancy.

The increase in input load through the long hole-shaped primary second rocker hinge hole 184, which occurs when the circuit breaker is switched from the tripped position due to an accident to the ON position, also occurs when the circuit breaker is switched from the manual OFF position to the ON position, and thus a detailed description of which will be omitted to avoid redundancy.

Next, the procedure of switching the circuit breaker from the ON position to the manual OFF position will be described.

In the ON position shown in FIG. 2, the handle 10 may rotate clockwise as shown in the drawing.

The tension spring S may rotate clockwise as shown in the drawing on the first spring fastener 52 by the rotation of the handle.

Accordingly, a spring force may be applied to the first spring fastener 52 upward to the right in the drawing.

The spring force may act as torque that causes the first rocker 40 to rotate counterclockwise as shown in the drawing around the first rotation axis 30.

The torque can cause the second pin 70 to move from the second side 184*b* of the long hole-shaped, primary second rocker hinge hole 184 to the first side 184*a*.

Also, the torque can cause the second rocker 180 to rotate counterclockwise as shown in the drawing around the second rotation axis 82.

As such, in the first 4-bar linkage, the first rocker 40 may rotate counterclockwise as shown in the drawing around the first rotation axis 30.

The connecting link 60 may rotate and move clockwise as shown in the drawing by means of the first rocker 40 and the first pin 50.

The second pin 70 may move from the second side 184*b* of the long hole-shaped, primary second rocker hinge hole 184 to the first side 184*a* by means of the connecting link 60.

The second rocker 180 may rotate counterclockwise as shown in the drawing around the second rotation axis 82 by means of the connecting link 60 and the second pin 70.

Accordingly, in the second 4-bar linkage, the third pin 92 may move counterclockwise as shown in the drawing along the circumference around the second rotation axis 82 by the rotation of the second rocker 180.

The transfer link 90 may rotate and move clockwise as shown in the drawing by means of the second rocker 180 and the third pin 92.

The moving contact OC may rotate clockwise as shown in the drawing around the moving contact rotation axis OCA by means of the transfer link 90.

The moving point of contact OCP may be separated from the fixed point of contact FCP by the rotation of the moving contact OC.

As a result, the circuit breaker is put into the manual OFF position shown in FIG. 3.

In this procedure, the long hole-shaped, primary second rocker hinge hole 184 can increase input load without increasing the load on the tension spring S.

Next, the procedure of switching the circuit breaker from the ON position to the tripped position due to an accident will be described.

In the ON position shown in FIG. 2, the latch holder 28 may rotate clockwise as shown in the drawing in the event of an abnormal current or fault current in a circuit.

As such, the protrusion 24 of the trip latch 20 may be released.

Accordingly, the trip latch 20 may rotate around the latch rotation axis 22.

In this case, the spring force applied to the first spring fastener 52 upward to the left in the drawing can cause the trip latch 20 to rotate counterclockwise as shown in the drawing around the latch rotation axis 22.

Moreover, the spring force can cause the second pin 70 to move from the second side 184*b* of the long hole-shaped, primary second rocker hinge hole 184 to the first side 184*a*.

Further, the spring force can cause the second rocker 180 to rotate counterclockwise as shown in the drawing around the second rotation axis 82.

Accordingly, referring to FIG. 2, in the 5-bar linkage, the trip latch 20 may rotate counterclockwise around the latch rotation axis 22.

The first rocker 40 may rotate and move counterclockwise as shown in the drawing by means of the trip latch 20 and the first rotation axis 30.

The connecting link 60 may rotate and move counterclockwise as shown in the drawing by means of the first rocker 40 and the first pin 50.

The second pin 70 may move from the second side 184*b* of the long hole-shaped, primary second rocker hinge hole 184 to the first side 184*a* by means of the connecting link 60.

The second rocker 180 may rotate counterclockwise as shown in the drawing around the second rotation axis 82 by means of the connecting link 60 and the second pin 70.

Accordingly, in the second 4-bar linkage, the third pin 92 may move counterclockwise as shown in the drawing along the circumference around the second rotation axis 82 by the rotation of the second rocker 180.

The transfer link 90 may rotate and move clockwise as shown in the drawing by means of the second rocker 180 and the third pin 92.

The moving contact OC may rotate clockwise as shown in the drawing around the moving contact rotation axis OCA by means of the transfer link 90.

The moving point of contact OCP may be separated from the fixed point of contact FCP by the rotation of the moving contact OC.

As a result, the circuit breaker is put into the tripped position due to an accident shown in FIG. 4.

As used herein, the first rocker 40 may be referred to as a drive joint, the first rotation axis 30 may be referred to as a rotation axis, the second pin 70 is referred to as a connecting pin, the long hole-shaped, primary second rocker hinge hole 184 may be referred to as a long hole-shaped hinge hole, the first spring fastener 52 may be referred to as a point of action, and the axis formed by the first spring fastener 52 and the second spring fastener 16 may be referred to as a line of action.

In the circuit breaker according to the present invention, a hinge part of a linkage that generates a driving force may include a long hole-shaped hinge hole and a connecting pin that is movable within the long hole-shaped hinge hole, and the connecting pin may move in the direction of increasing tangential force, a component of the driving force, which acts as input load.

More specifically, the circuit breaker according to the present invention may include a case C, a fixed contact FC mounted within the case C, a moving contact OC rotatably mounted on the case C to be brought into contact with or separated from the fixed contact FC, and a switching mechanism that generates a driving force to rotate the moving contact OC.

The switching mechanism may include a linkage with a drive joint that is mounted to be rotatable around the rotation axis by the driving force.

During the ON operation, an axis formed by the rotation axis and the point of action of the driving force makes an acute angle with the line of action of the driving force, so that the drive joint causes the tangential force to act as input load at the circumference of the point of action of the driving force.

At least one hinge part of the linkage is configured in a way that the connecting pin is movably hinged to the long hole-shaped hinge hole.

Accordingly, during the ON operation, at least one hinge part of the linkage causes the tangential force to increase by changes in the acute angle as the connecting pin moves from a first side of the long hole-shaped hinge hole to a second side.

As such, it is possible to increase input load, without developing a new switching mechanism by increasing the load on a tension spring or changing the link structure and link ratio of a switching mechanism.

Therefore, there might be no problems caused by different approaches to increase input load.

For example, a problem of increased load for all operations except the ON operation might not occur, wherein the problem might be caused by increasing the load on the tension spring.

Moreover, an unnecessary effects (e.g., increasing the user operability for a reset operation) on operations other than the ON operation and a problem in using a switching mechanism to other type breaker might not occur, wherein the unnecessary effects and the problem might be caused by changing the link structure and link ratio of the switching mechanism.

Further, the time and cost of development and improvement required to increase input load by increasing the load on the tension spring or changing the link structure and link ratio of the switching mechanism can be considerably reduced.

In addition, the tangential force of the driving force, which changes with the movement of the connecting pin within the long hole-shaped hinge hole, may be applied to other parts as well.

Consequently, the performance of other operations such as a manual OFF or a tripping operation due to an accident can be improved.

What is claimed is:

1. A circuit breaker comprising:

a case;

a fixed contact mounted within the case;

a moving contact rotatably mounted on the case to be brought into contact with or separated from the fixed contact; and a switching mechanism that generates a driving force to rotate the moving contact, the switching mechanism comprising a linkage with a drive joint that is mounted to be rotatable around a rotation axis by the driving force, wherein, during an ON operation, an axis formed by the rotation axis and a point of action of the driving force makes an acute angle with a line of action of the driving force such that a drive joint causes a tangential force at a circumference of the point of action of the driving force to act as an input load, wherein at least one hinge part of the linkage is configured such that a connecting pin is movably hinged to a long hole-shaped hinge hole, wherein, during the ON operation, the at least one hinge part of the linkage causes the tangential force to increase by changes in the acute angle as the connecting pin moves from a first side to a second side of the long hole-shaped hinge hole, wherein the linkage comprises:

a trip latch, a first end of which is hinged to an inside of the case and a second end of which is held by a latch holder;

a first rocker, a first end of which is hinged to the trip latch by a first rotation axis;

a second rocker spaced away from the first rocker and a first end of which is hinged to the case by a second rotation axis; and a connecting link, a first end of which is hinged to a second end of the first rocker by a first pin and a second end of which is hinged to a second end of the second rocker by a second pin, wherein the second rocker comprises a long hole-shaped second rocker hinge hole at the second end, and wherein the connecting link is hinged to the long hole-shaped second rocker hinge hole, and wherein the first rocker is the drive joint, the first rotation axis is the rotation axis, the second in is the connecting pin, and the long hole-shaped second rocker hinge hole is the long hole-shaped hinge hole.

2. The circuit breaker of claim 1, wherein:

the long hole-shaped second rocker hinge hole represents a terminal symbol of a flowchart; and a first arc of the symbol is the first side of the long hole-shaped hinge hole and a second arc of the symbol is the second side of the long hole-shaped hinge hole.

3. The circuit breaker of claim 1, wherein the switching mechanism further comprises:

a handle spaced away from the linkage, a first end of the handle hinged to the case and a second end of the handle protruding from the case; and a tension spring, a first end of which is supported on the handle and a second end of which is supported on the first pin, the tension spring exerting a driving force on the first pin, wherein the first pin comprises a first spring fastener for supporting the first end of the tension spring, and wherein the handle comprises a second spring fastener on one side to support the second end of the tension spring, and wherein the first spring fastener is the point of action and an axis formed by the first spring fastener and the second spring fastener is the line of action.

4. The circuit breaker of claim 3, wherein the first side of the long hole-shaped hinge hole is formed in a position where a first acute angle is formed by the first rotation axis, the first spring fastener, and the second spring fastener when the connecting pin is located on the first side during the ON operation.

5. The circuit breaker of claim 4, wherein the second side of the long hole-shaped hinge hole is formed in a position where a second acute angle larger than the first acute angle is formed by the first rotation axis, the first spring fastener, and the second spring fastener when the connecting pin is located on the second side during the ON operation.

6. The circuit breaker of claim 1, wherein the switching mechanism further comprises a transfer link that transfers a driving force from the linkage to the moving contact, a first end of the transfer link being hinged to the first side of the second rocker and a second end of the transfer link being hinged to one side of the moving contact.

* * * * *